United States Patent [19]

Becker

[11] Patent Number: 4,793,406

[45] Date of Patent: Dec. 27, 1988

[54] TUBE SPACING GRID

[75] Inventor: Reinhold Becker, Oberhausen, Fed. Rep. of Germany

[73] Assignee: MAN Gutehoffnungshütte GmbH, Fed. Rep. of Germany

[21] Appl. No.: 93,823

[22] Filed: Sep. 8, 1987

[30] Foreign Application Priority Data

Sep. 8, 1986 [DE] Fed. Rep. of Germany ..... 3630502

[51] Int. Cl.[4] ..... F28F 9/00

[52] U.S. Cl. ..... 165/162; 122/510

[58] Field of Search ..... 165/162; 122/510

[56] References Cited

U.S. PATENT DOCUMENTS 4,021,204 5/1977 Straffi ..... 165/162 X

FOREIGN PATENT DOCUMENTS

EP0125324 11/1984 European Pat. Off. ..... 165/162

2840146 3/1980 Fed. Rep. of Germany ..... 165/162

383992 3/1972 U.S.S.R. ..... 165/162

821902 4/1981 U.S.S.R. ..... 165/162

*Primary Examiner*—Michael Koczo

*Assistant Examiner*—Peggy Neils

*Attorney, Agent, or Firm*—McGlew and Tuttle

[57] ABSTRACT

A tube spacing grid for the guidance of tubes such as in steam generators includes mutually intersecting grid rods disposed in two planes and surrounded as a frame by an outer ring. The outer ring has a circling groove on its interior face and the grid rods are inserted in seating slots formed in an interior face of a one-piece inner ring (B). A tongue and groove connection is provided between the grid rods and the inner ring. The inner ring, with the grid rods inserted in the slots and retained at a radial and axial distance from each other, is encircled by a multiple-part, particularly a two-part in axial direction, outer ring.

2 Claims, 2 Drawing Sheets

TUBE SPACING GRID

BACKGROUND OF THE INVENTION

FIELD OF THE INVENTION

The invention relates in general to vapor generators and in particular to a new and useful tube spacing grid for the guidance of tubes which is formed of intersecting grid rods and surrounded by an outer ring frame which has an interior encircling groove.

Known are so-called spacers for the pipes of pipe equipment having a nest of pipes (DE-PS No. 22 62 621) where the grid rods of the grid are fastened to an annular frame in such a manner that the frame has on its outer face holes; and has on its inside an encircling groove with rod or bushing receiving lateral slots forming retention means for the grid rods. In this construction the grid, frame and steam generator wall are rigidly interconnected.

In a grid shaped guide retainer for heat exchanger tubes according to DE-PS No. 24 15 242, the rods of the grid have, at the outer rim zone of each grid grate, grooves engaged with radial play by projections of the frame. Grid grates and frames are made of different materials and react differently to temperature changes and the design of this grid is complicated and expensive. The design of the spacers necessitates preassembly of the grid without the frame, and only thereafter can turning for final assembly be performed.

SUMMARY OF THE INVENTION

According to the invention a one-piece inner ring contains seating slots for a plurality of intersecting grid rods.

According to the invention the assembly of one or more layers of the grid rods and the inner ring provides, in addition to an efficient manner of spacing the tubes, a one function unit. The detention of the grid rods in the inner ring makes the grid stable to the introduction of thrust, tensional and bending forces such as may occur when putting in the tubes, when turning or transporting and ultimately also when stressed due to earthquakes.

In the design according to the already mentioned DE-PS No. 24 15 242, i.e. the assembly grid rods, inner ring and spacers, the grid rods are permitted to engage the outer ring with the consequence that the grid rod stress, particularly in tension, is considerable because the outer ring must be of especially rugged design due to its size and shape and because of the function it must perform, namely holding the entire grid system.

In the design according to the invention, inner rings with grid rods form an optimal cushioning system for the guidance of nests of tubes to counter the introduction of forces of any kind.

Deformation of the inner ring in the event of the above mentioned stresses is impossible because the play between the inner ring and the outer ring is designed to be no greater than necessitated by the calculated thermal expansion. Furthermore, because of the multiplicity of grid rods connected to both the upper and lower plane sides of the inner ring by means of the tongue and groove connection, the inner ring is protected from getting out of round. The function and the principle are comparable to the wire spokes of a bicycle.

The invention provides for designing the torque and groove connection of the grid rods to the inner ring so that there is machined into the grid rod ends a groove in which the projection in the respective rod seating slot of the inner ring engages. Theoretically, the tongue and groove connection could instead also be designed so that the grid rod has the projection (tongue) and the seating slot of the inner ring the groove. However, the first mentioned design is simpler to produce and less expensive.

Some features are already described in the tube spacing grid according to the German Patent Application No. P 35 40 229.6 can expediently be used also in the present tube spacing grid design.

Thus, the outer ring is of multiple-piece, especially two-piece design, the parting planes running in axial direction of the outer ring. Also, the plane surfaces of the groove in the outer ring may have helical flutes to serve the flushing away of deposits which may accumulate during the operation of a steam generator. Finally, there may be disposed at the outer rim of the outer ring several straight or beveled stops serving the alignment of the tube spacing grid in the steam generator tank.

Accordingly, an object of the invention is to provide a tube spacing grid for the guidance of tubes in a vapor generator which includes an outer ring with an inner wall having a encircling groove to which a single piece inner ring is positioned which has a plurality of receiving slots which are engaged by a plurality of intersecting grid rods which define a tube guidance for holding the tubes in base relationships between their intersecting portions and wherein the inner ring and the rods have inter engaging tongue and groove portions in their inter connecting ends.

A further object of the invention is to provide a spacing grid which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawing and descriptive matter in which a preferred embodiment of the invention is illustrated.

GENERAL DESCRIPTION OF THE PREFERRED EMBODIMENTS

Figure 1:
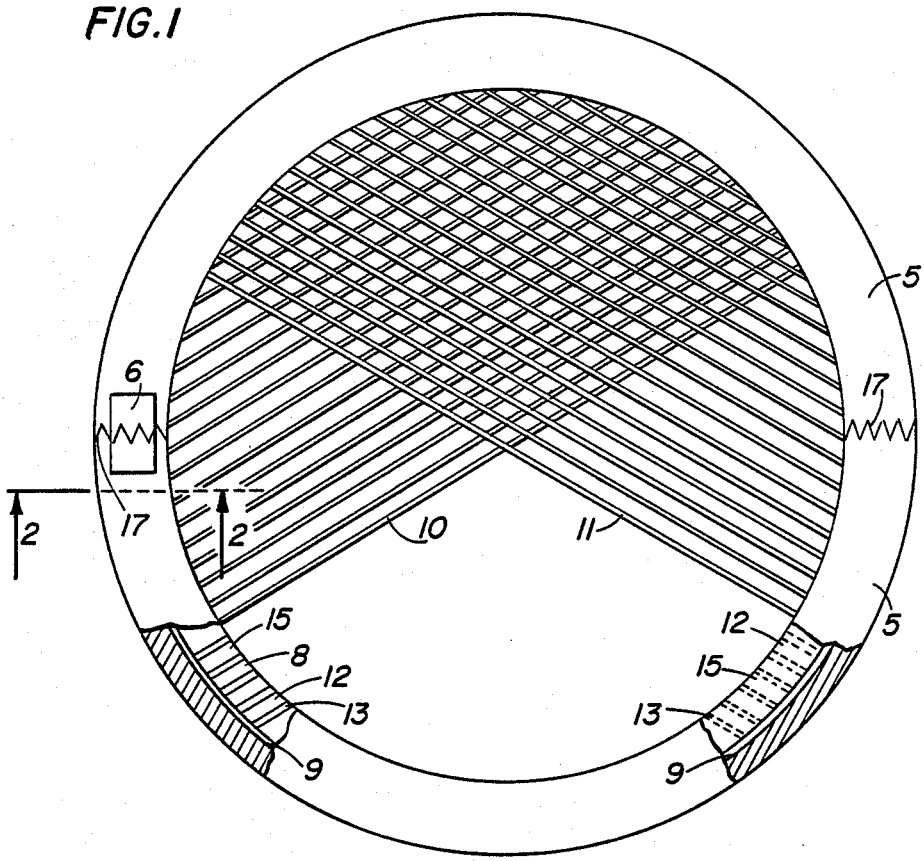
FIG. 1 is a top plan view partly broken away of a circular tube spacing grid.

Referring to the drawings in particular the invention embodied therein comprises a tube spacing grid for spacing tubes in a heat exchanger or steam generator and which includes an outer ring 5 having an inner wall with an encircling groove 9 into which is positioned a single piece inner ring 8 which has an interior or planar face with a plurality of grid rod receiving slots or rod receiving grooves 13. A plurality of intersecting grid rods 10 and 11 at their respective ends in the associated receiving slot 13 and the inner ring 8 and the rods 10 and 11 have inter engaging tongue and groove portions at the associated engaged ends.

A feature of the invention is that the outer ring 5 is made of multi-part construction with the parts joined together along a joining line 17 and secured in position for example by a cover 6.

The top view of a tube spacing grid in FIG. 1 shows a two-piece outer ring 5 with e.g. toothed parting lines to obtain the ring stiffness of a solid ring. Cover plates 6 are welded to both plane surfaces for further stability. In both broken away areas in FIG. 1 the one-piece inner ring B which is placed in a radially inwardly opening encircling groove 9 of the outer ring 5 may be seen. Only half of each of the two layers of grid rods 10 and 11 each are shown in this top view for the sake of better clarity. Rod seating grooves 13 are milled into the inner circumferential surfaces 12 of the inner ring 8 at angles in accordance with the grid rod pitch. These milled seating grooves 13 and end face grooves 14 turned radially in the outer ring 5 define tongues 15 for the grooves 16 of the tongue and groove connection between inner ring 8 and the grid rods 10 and 11.

The cover plates 6 are shown offset by 180 degrees each to their actual position at the parting lines 17 of the outer ring 15. The tongue and groove connection between upper and lower grid rod layers 10 and 11 is visible in the area 18. The grid rods 10 and 11 have, at both their ends, grooves 16 with which they engage the tongues 15 of the inner ring 8 in two places. This establishes, similar to the function of bicycle spokes, an elastic, yet firm connection between the inner ring 8 and the two grid rod planes 10 and 11 at appropriately specified tolerances.

Figure 2:
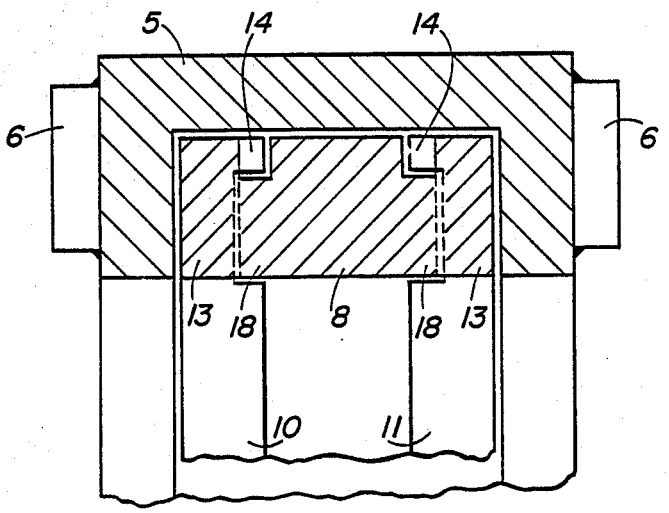
FIG. 2 is a sectional view along line 2—2 of FIG. 1, in the assembled state.
Figure 3:
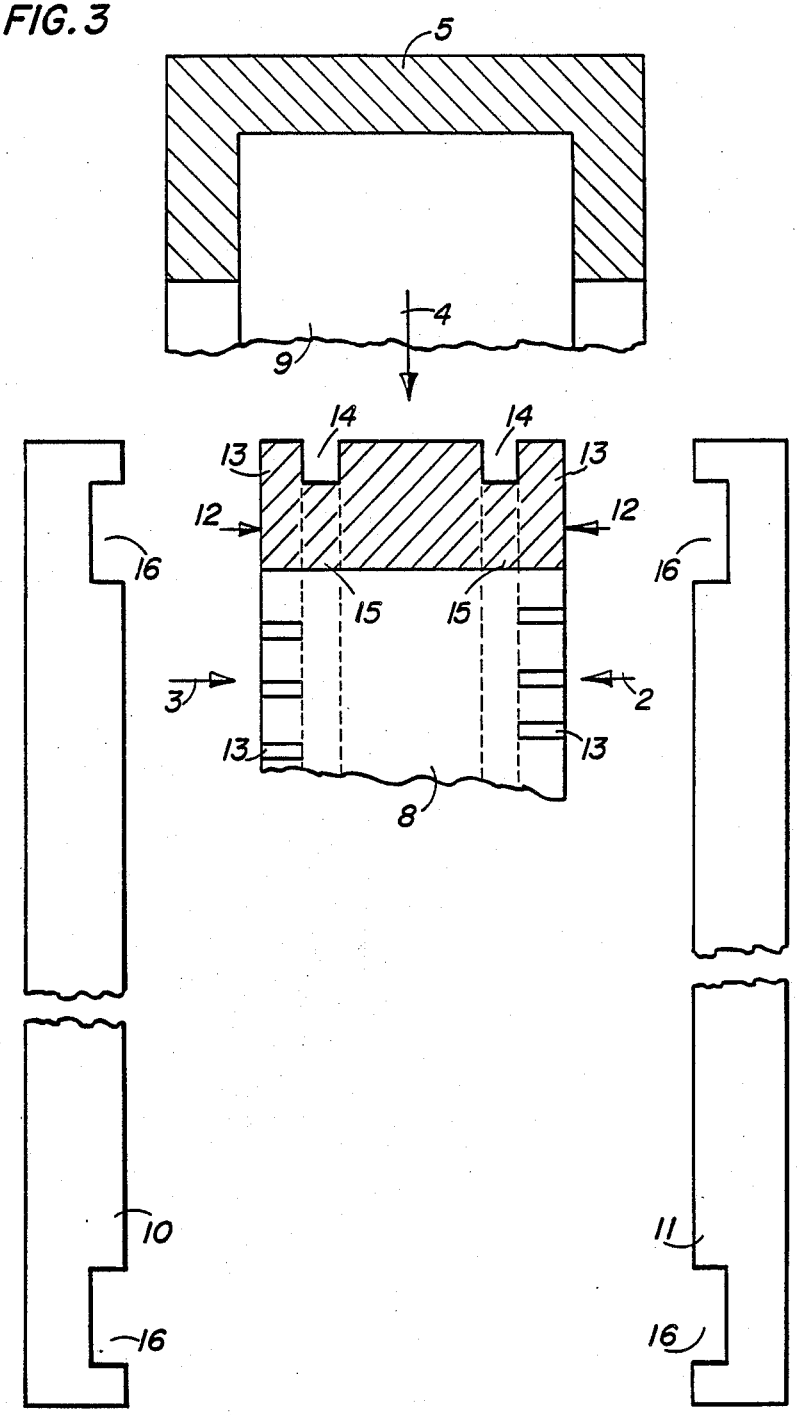
FIG. 3 is an exploded partial elevational and sectional view showing the order in which outer ring, inner ring and grid rods are successively assembled, according to the illustration in FIG. 2.

The few parts of a tube spacing grid, outer ring 5, inner ring 8, grid rods 10 and 11 are shown in an exploded view in FIG. 3. The preassembly state is depicted. The state according to FIG. 2 is obtained by the assembly sequence 2 - 3- 4. Variations of the parting lines 17 in the outer ring 5, as well as of adjustment and fastening methods of a tube spacing grid in steam generators, for example, and a rectangular instead of a circular form of a tube spacing grid or of other features can also be used in the tube spacing grid described here, in accordance with the not prepublished German Patent Application No. P 35 40 229.6.

While a specific embodiment of the invention has been shown and described in detail to illustrate the application of the principles of the invention, it will be understood that the invention may be embodied otherwise without departing from such principles.

What is claimed is:

1. A tube spacing grid for guiding the pipes of a vapor generator, comprising: a grate formed of intersecting grate rods arranged in more than one plane, said grate rods each having grate rod ends, each end having a tongue and a groove portion; an outer ring with an inner wall having an encircling groove, said outer ring being of at least two interengaged parts; a single piece inner ring positioned within said groove having an interior planar face with a plurality of grid rod receiving slots, each slot adapted to receive one of said grate rods, each of said receiving slots of said inner ring having a tongue member forming a tongue and groove portion within said receiving slot, the tongue portion of each said grate rod end engaging a groove portion within one of said receiving slots and said groove portion of each said grate rod end engaging a tongue portion in one of said receiving slots, said tongue portion of each said receiving slot being smaller than the associated said groove portion of each of said grate rod end, thereby allowing said grate rods to move relative to said inner ring under thermal stress.

2. A tube spacing grid according to claim 1, wherein: said two interengaged parts of said outer ring include first and second mating portions associated with each of said two interengaged parts includes a toothed joining part, each of said toothed joining parts adapted to engage a corresponding toothed joining part.

* * * * *